United States Patent [19]

Evezich

[11] Patent Number: 4,909,416

[45] Date of Patent: Mar. 20, 1990

[54] DEVICE FOR CONTAINING AND DISPENSING FLOWABLE MATERIALS

[76] Inventor: Paul D. Evezich, P.O. Box 431, Frederick, Colo. 80530

[21] Appl. No.: 226,271

[22] Filed: Jul. 29, 1988

Related U.S. Application Data

[63] Continuation-in-part of Ser. No. 874,676, Jun. 16, 1986, Pat. No. 4,760,937.

[51] Int. Cl.[4] ..... B65D 35/28

[52] U.S. Cl. ..... 222/95; 222/105; 222/209; 222/386.5

[58] Field of Search ..... 222/94, 95, 105, 183, 222/211-213, 209, 325, 386.5, 566, 568, 575, 326

[56] References Cited

U.S. PATENT DOCUMENTS

| | | | |
|---|---|---|---|
| 2,715,981 | 8/1955 | Moubayed . | |
| 2,804,995 | 9/1957 | Fee | 222/386.5 X |
| 3,223,289 | 12/1965 | Bouet | 222/95 X |
| 3,294,289 | 12/1966 | Bayne et al. | 222/95 |
| 3,342,377 | 9/1967 | Peredy | 222/94 |
| 3,474,936 | 10/1969 | McDonnell . | |
| 3,876,119 | 4/1975 | Lamkin | 222/389 X |
| 4,147,278 | 4/1979 | Uhlig | 222/95 X |
| 4,213,545 | 7/1980 | Thompson et al. | 222/389 X |
| 4,469,250 | 9/1984 | Evezich | 222/95 X |

*Primary Examiner*—Joseph J. Rolla
*Attorney, Agent, or Firm*—Harold A. Burdick

[57] ABSTRACT

A device is disclosed for containing and dispensing flowable materials contained in an inner container which is located within an outer container. The inner container includes a first portion having a nozzle affixed to one end thereof and a readily reshapable bladder affixed to the other end thereof, with the nozzle having a first one-way check valve permitting ejection of the contents from the inner container. The outer container has a second one-way valve to admit air from the exterior of the device to the space between the inner and outer containers and a compressible volume reducing structure for reducing the volume of the outer container without direct contact by a user with the volume reducing structure.

19 Claims, 3 Drawing Sheets

27
39
31
29
21
19
33
25
37
35
23
15
63
49
47
51
45
43
41
53
57
55
65
61
59

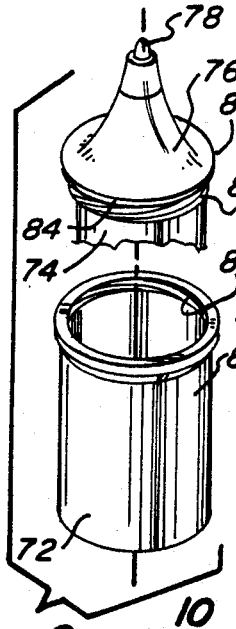
Fig_6
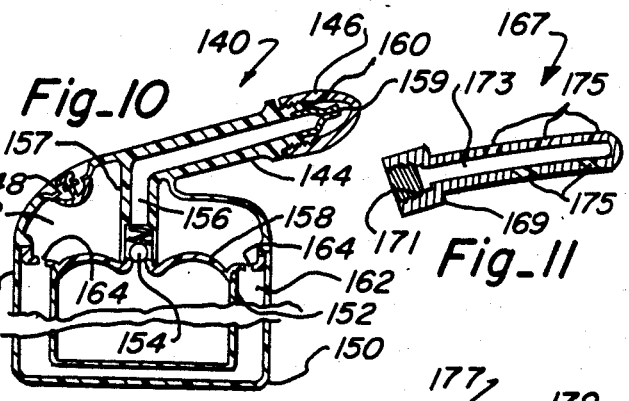
Fig_10
Fig_11
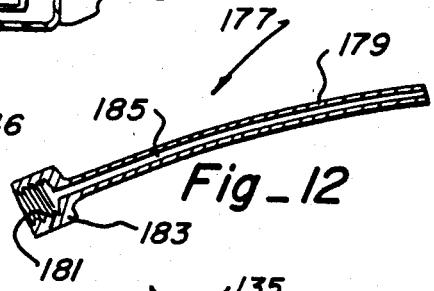
Fig_12
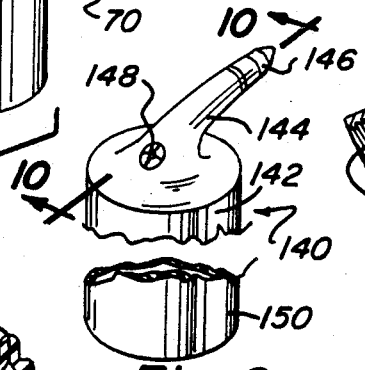
Fig_9
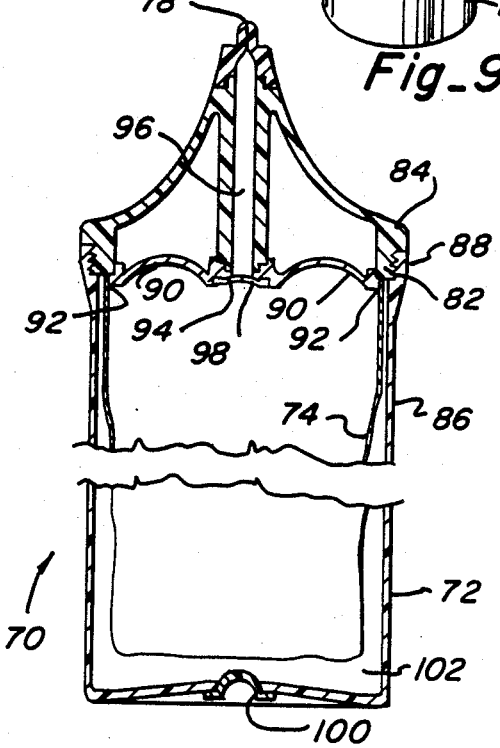
Fig_7
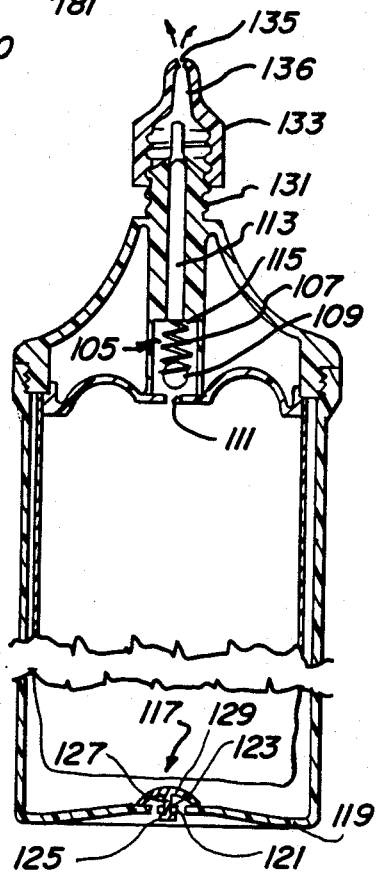
Fig_8

DEVICE FOR CONTAINING AND DISPENSING FLOWABLE MATERIALS

RELATED INVENTION

This Application is a Continuation-In-Part of copending U.S. Patent Application Ser. No. 874,676, filed June 16, 1986 now issued as U.S. Pat. No. 4,760,937 on Aug. 2, 1988, entitled "Squeezable Device For Ejecting Retained Materials".

FIELD OF THE INVENTION

This invention relates to dispensing devices and, more particularly, relates to dispensing devices for containing and dispensing flowable materials.

BACKGROUND OF THE INVENTION

Squeezable dispensing devices for dispensing flowable materials are well known and such devices have heretofore been developed and/or utilized wherein bladder containment and/or pressure dispensing are shown. Such arrangements, for example, are described in U.S. Pat. No. 3,225,967 issued Dec. 28, 1965 to J. Heimgartner and U.S. Pat. No. 3,270,920 issued Sept. 6, 1966 to C. G. Nessler showing an arrangement wherein the contents of a bladder are urged therefrom by a supply of gas and which makes use of valves to modulate the expulsion of the contents from the bladder.

Another arrangement making use of a bladder containing materials to be dispensed by pressure is shown in U.S. Pat. No. 4,469,250 issued Sept. 4, 1984 to Evezich (the Applicant herein). In this arrangement a separate bladder is housed within a squeezable outer shell having a removable cap and nozzle construction and requiring a projection positioned at the base of the nozzle for piercing the bladder to allow dispensing of its contents, the various elements not being permanently affixed to one another.

Dispensing devices have also heretofore been known and/or utilized wherein an inflatable bladder is utilized to push contents out of a container (see for example U.S. Pat. No. 3,592,365), as have devices utilizing volume reducing structures for selectively changing the volume of the dispensing device (see for example U.S. Pat. Nos. 2,715,981, 3,474,936, 4,098,434, and 4,147,278).

While dispensing devices making use of bladders and/or pressure dispensing have heretofore been suggested and/or utilized, further improvements could nevertheless still be utilized.

SUMMARY OF THE INVENTION

This invention provides an improved dispensing device for containing and dispensing flowable materials, for example. Dispensing of materials is achieved through use of an inner container housed within an outer container, the inner container including a first portion containing material to be dispensed and communicating with the exterior of the device through a nozzle affixed to one end thereof and having a readily reshapable portion affixed to the other end thereof. A one-way check valve is positioned at an outlet opening in the nozzle to permit flow of the contents of the inner container therethrough but precluding passage of matter into the inner container. A second one-way check valve is positioned to permit the flow of air from the exterior of the device to the volume defined between the inner container and outer container. The outer container may be squeezable, or may include a compressible volume reducing structure for reducing the volume of the outer container without direct contact by a user of the device with the volume reducing structure.

It is therefore an object of this invention to provide an improved containing and dispensing device for containing and dispensing flowable materials.

It is another object of this invention to provide an improved containing and dispensing device for dispensing flowable materials which has an inner container including a readily reshapable portion and in which the contents of the inner container are substantially protected from contaminants.

It is still another object of this invention to provide an improved containing and dispensing device for dispensing flowable materials including an inner container and an outer container, with the outer container having a volume reducing structure for selectively reducing the volume of the outer container.

It is yet another object of this invention to provide an improved containing and dispensing device for dispensing flowable materials having a disposable inner container and nozzle portion and a reusable outer container.

It is still another object of this invention to provide an improved dispensing device for dispensing flowable materials having an outer container for containing an inner container including a relatively rigid containment portion for protection of the flowable materials against leakage and the like during shipment and/or use, a readily reshapable inflatable portion for expelling the contents of the relatively rigid portion, and a nozzle.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which:

FIG. 6 is a partial, exploded view of a second embodiment of a dispensing device;

FIG. 7 is a partial sectional view of the embodiment of the device shown in FIG. 6;

FIG. 8 is a partial sectional view of a third embodiment of a dispensing device and particularly illustrating one alternative nozzle and valving;

FIG. 9 is a partial perspective view of a fourth embodiment of a dispensing device;

FIG. 10 is a partial sectional view of the embodiment of the device of FIG. 9 taken along section line 10—10;

FIG. 11 is a sectional view of one available auxiliary attachment usable with the dispensing device of this invention;

FIG. 12 is a sectional view of a second auxiliary attachment usable with the dispensing device of this invention;

DESCRIPTION OF THE INVENTION

FIGS. 1 through 12 show a device shown, described and claimed in U.S. Patent Application Ser. No. 874,676 and are described herein as background and to illustrate certain basic structural elements of this invention.

Figures 1, 2, 3, 4, 5:
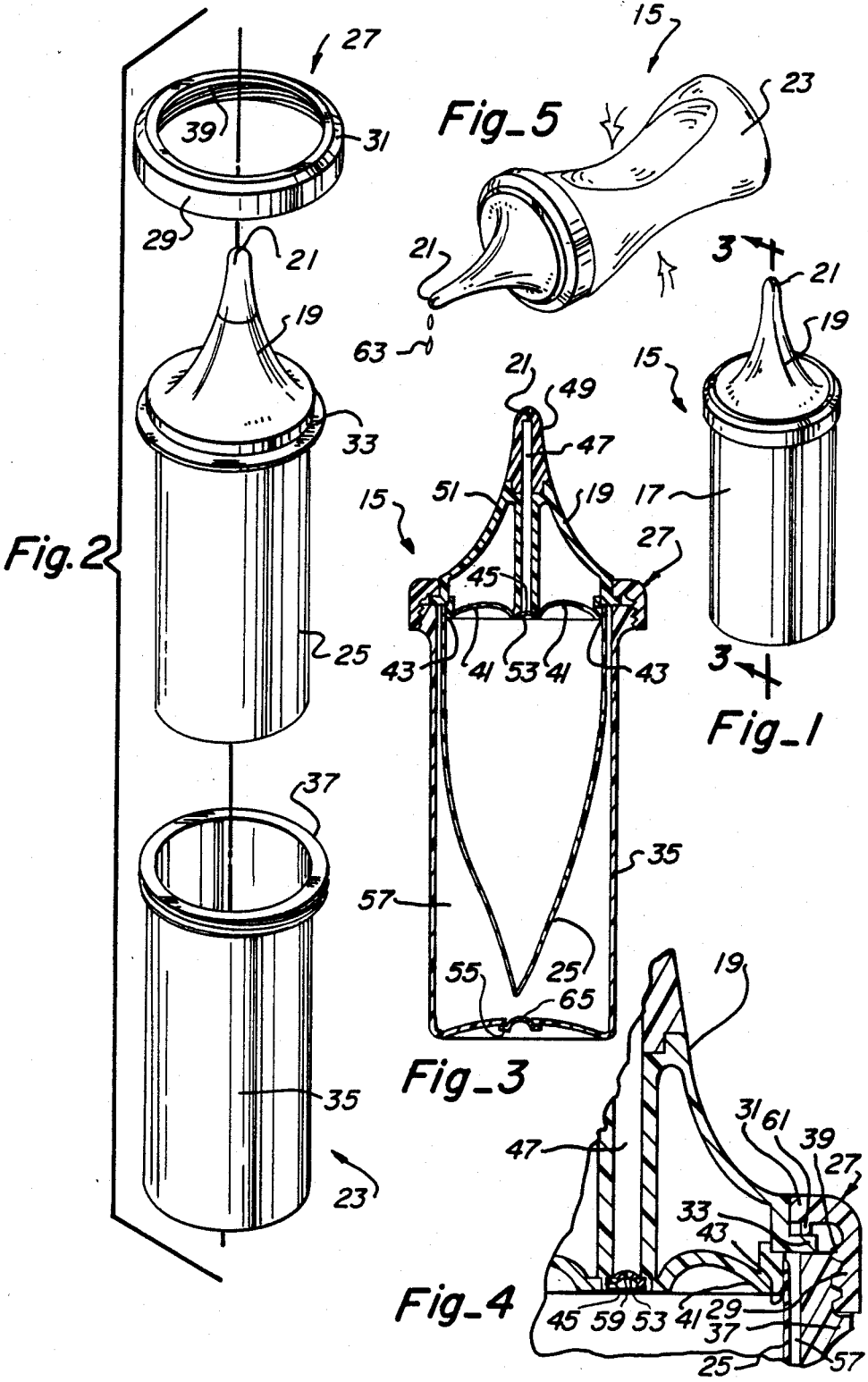
FIG. 1 is a perspective view of a first embodiment of a dispensing device.
FIG. 2 is a partially exploded perspective view of the dispensing device of FIG. 1.
FIG. 3 is a sectional view of the device of FIG. 1 taken along section line 3—3.
FIG. 4 is a partial sectional view of the device of FIG. 3 particularly illustrating the relationship of the two component external container.
FIG. 5 is a perspective view of the device of FIG. 1 showing material being dispensed.

Referring now to the drawings, a storage and dispensing device 15 for storing and dispensing materials is shown in FIG. 1. As shown, dispensing device 15 includes body 17 and dispensing conduit, or nozzle, 19 having an outlet terminus 21.

As best shown in FIG. 2, dispensing device 15 includes three components, a resilient outer container 23, a deformable, or readily reshapable, inner container 25, and a retainer ring 27 engagable with resilient outer container 23. Retainer ring 27 includes a threaded base 29 and a retainer lip 31. Deformable inner container 25 has thereon, at the joinder between deformable inner container 25 and nozzle 19, an annular ridge 33. Resilient outer container 23, in turn, includes inner container housing 35 having external threads 37 at the upper portion or body section thereof, external threads 37 being engagable with internal threads 39 of the retainer ring, thereby maintaining deformable inner container 25 within resilient outer container 23 by clamping of annular ridge 33 between retainer lip 31 and housing 35, and maintaining nozzle 19 through retainer ring 27.

As best shown in FIG. 3, dispensing device 15 includes curved nozzle base 41, which base is curved toward the inner portions of nozzle 19, and which, together with deformable inner container 25 provides a storage area for the materials to be dispensed. Deformable inner container 25 is permanently affixed, or joined, to nozzle 19, and, more particularly, is permanently connected with curved nozzle base 41 at joinder 43 which defines the outer circumference of curved nozzle base 41. Inlet terminus 45 defines an inner circumference of curved nozzle base 41, inlet terminus 45 opening to dispensing channel 47 and outlet terminus 21 through nozzle 19.

Nozzle 19 includes two sections, nozzle tip 49, and nozzle body 51. At inlet terminus 45, one-way valve 53 (which may be any of a variety of one-way valves known commercially) is disposed allowing passage of materials from deformable inner container 25 to dispensing channel 47, while substantially precluding movement of matter from dispensing channel 47 back into inner container 25.

At the bottom portions of inner container housing 35, a second one-way valve 55 (which may also be any of a variety of one-way valves known commercially) is located, which valve allows passage of air from the exterior of the dispensing device to volume 57 defined between inner container housing 35 and inner container 25. Valve 55 substantially precludes passage of air from volume 57 to the exterior of the dispensing device.

Turning now to FIG. 4, details of the two part outer container and one-way valving are shown. Valve 53 is shown, for example, to be a curved valve positioned at inlet terminus 45. While curved in its cross-section, valve 53 is more accurately viewed as a dome-shaped valve having its convex portion facing into dispensing channel 47 and its concave portion being presented to the interior of deformable inner container 25. Valve 53 is constructed, for example, of a resilient material having negligible resilience to stresses imposed against its convex surface but being resilient with regard to stresses imposed on its concave surface. Passageway 59 in valve 53 opens in response to stresses to the convex surface to allow passage of materials from inner container 25 to dispensing channel 47 and thereafter through outlet terminus 21, such stress being created by application of pressure to inner container 25, for example, by the squeezing of outer container 23.

As also shown in FIG. 4, retainer ring 27 is engagable at internal threads 39 by external threads 37 of resilient outer container 23 Retainer lip 31 brings annular clamping projection 61 to bear upon annular ridge 33 thereby clamping the annular ridge between clamping projection 61 and the upper surface of external threads 37 and sealing volume 57 at its upper extremity.

It may be seen, therefore, that when resilient outer container 23 is depressed, as shown in FIG. 5, material 63 is forced through outlet terminus 21 as air within volume 57 creates pressure on inner container 25. When inner container 25 is thus compressed, materials are forced through one-way valve 53 and into dispensing channel 47 and ultimately through outlet terminus 21. Upon release of resilient outer container 23, the outer container begins to return to its original shape thereby relieving the pressure on inner container 25 and allowing passageway 59 in valve 53 to close. However, deformable inner container 25 stays in its deformed shape as no air or other matter is allowed to pass back through valve 53 and occupy any volume thereof. As resilient outer container 23 regains its shape it draws air through one-way valve 55 from the exterior of the device through opening 65 into volume 57. When outer container 23 has fully regained its shape, the pressure between volume 57 and the exterior of the device will equalize thus allowing opening 65 in valve 55 to close, thereby disallowing passage of air back from volume 57 to the exterior cf the device. When all of this has occurred, the process may be repeated, the volume of air within resilient outer container 23 thus being sufficiently replenished to continually apply pressure to inner container 25 until the inner container is substantially completely deformed and emptied of its contents.

Curved nozzle base 41 is configured so that a cone in deformable inner container 25 is not formed as would be the case if the nozzle base were flat, thereby allowing deformable inner container 25 to enter into the volume of the convex curvature of curved nozzle base 41 for a more complete evacuation of the contents within inner container 25.

Turning now to FIGS. 6 and 7, a second embodiment of a dispensing device is shown. Dispensing device 70 includes a resilient outer container 72 and a deformable inner container 74 which is preferably permanently joined with nozzle 76. Nozzle 76 may be identical in structure to that of nozzle 19 above-described, and includes outlet terminus 78 and base 80, base 80 having external threads 82 positioned below a sealing ridge 84. Outer container 72 includes inner container housing 86 having internal threads 88 at the upper portion thereof, internal threads 88 and external threads 82 of nozzle 76 being engagable.

Dispensing device 70 has many of the features of the dispensing device shown in FIG. 3. Curved nozzle base 90 is shown in FIG. 7 which, together with inner container 74 preferably permanently joined at joinder 92, forms the storage area for the materials. Base 90 has inlet terminus 94 at its inner circumference leading to dispensing channel 96 through one-way valve 98. At the bottom portion of resilient outer container 72, one-way valve 100 is disposed for the passage of air from the exterior of the device to volume 102 defined between outer container 72 and inner container 74. The dispensing device operates in the same manner as the previous embodiment, with the exception that nozzle 76 and inner container 74 form a unitary structure thereby providing a two-part construction for the dispensing device engagable at external threads 82 of nozzle base 80 and internal threads 88 at the upper portion of resilient outer container 72, the two portions when tightly engaged bringing annular sealing ridge 84 into a substantially sealing relationship with the upper portion of the internal threads 88 of outer container 72 thereby sealing volume 102 thereat.

In FIG. 8 a third embodiment of a dispensing device is shown, in many ways similar to the device shown in FIG. 7, but showing alternative one-way valving and selective dispensing channel closure. Turning first to the alternative one-way valving, one-way valve 105 is shown to include spring 107 and stopper 109, spring 107, at one end thereof, biasing stopper 109 toward inlet terminus 111 to dispensing channel 113, and spring 107 at its other end resting against support surface 115. When materials are being urged through inlet terminus 111, stopper 109 is forced away from inlet terminus 111 to dispensing channel 113 thereby allowing passage of materials, but when material flow ceases, spring 107 urges stopper 109 back into a sealing relationship with inlet terminus 111 thereby preventing the movement of air and matter from dispensing channel 113 through inlet terminus 111.

A second alternative one-way valve 117, is shown at the lower portion of the alternative embodiment shown in FIG. 8. Valve 117 is positioned in resilient outer container 119, at air inlet 121, through mounting hole 123 being held in place by retainer 125 at the exterior of the dispensing device. Retainer 125 is connected to valve flaps 129 by connector 127. As resilient outer container 119 begins to regain its shape after deformation, and air is drawn through air inlet 121 from the exterior of the device, valve flaps 129 are forced open thereby allowing the passage of air into the device until the pressure is equalized, whereupon the valve flaps 129 are closed.

Also shown in FIG. 8, threaded nozzle tip 131 is provided for receipt of threaded cap 133, threaded nozzle tip 131 and threaded cap 133 together providing outlet terminus 135. Outlet terminus 135 is normally closed where no stresses are imposed on inner walls 136 of threaded cap 133. However, when threaded cap 133 is tightened against threaded nozzle tip 131, normally closed outlet terminus 135 is forced into its open position thereby allowing materials to escape from the dispensing device.

Turning to FIG. 9, a fourth embodiment of a dispensing device 140 is shown, the device having a one-piece resilient body 142 having a nozzle 144 closed by removable sealing cap 146. Resilient body 142 includes one-way valve 148 at the upper portion thereof for selectively allowing passage of air from the exterior of dispensing device 140 to interior portions thereof.

As shown in FIG. 10, it may be appreciated that this one-piece construction of the dispensing device is similar in many regards to the prior embodiments shown herein. Body 142 is shown to include resilient outer container 150, as well as nozzle 144 and deformable inner container 152 having one-way valve 154 (similar to the valving shown in FIG. 8 for example) at the inlet terminus of dispensing channel 156. Dispensing channel inner walls 157 are joined with curved nozzle base 158 which in turn is joined with deformable inner container 152. Removable sealing cap 146 covers outlet terminus 159 of nozzle 144, being engagable at threaded nozzle tip 160. In this embodiment, volume 162 defined between resilient outer container 150 and deformable inner container 152 is shown to extend into portions of nozzle 144 through annular opening 164, thereby allowing placement of one-way valve 148 at the upper portion of the dispensing device, for passage of air from the exterior of the device into volume 162.

In FIG. 11 one of many auxiliary attachments usable with the dispensing device is shown. Nozzle extender 167 includes nozzle engaging base 169 having internal threads 171 therein for attachment of the nozzle extender to, for example, threaded nozzle tip 131 (shown in FIG. 8) or threaded nozzle tip 160 (shown in FIG. 10). Dispensing channel extension 173 resides through nozzle extender 167 and has multiple outlet termini 175.

In FIG. 12 a second nozzle extender 177 is shown. Herein a resilient nozzle 179 is shown with internal threads 181 at base 183 thereof and having dispenser channel extension 185 therethrough.

Figure 13:
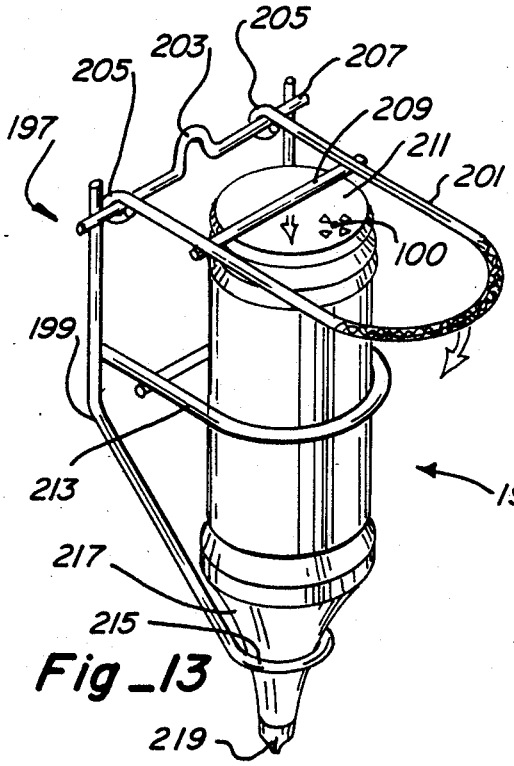
FIG. 13 is a perspective view of the dispensing device of this invention.
Figure 14:
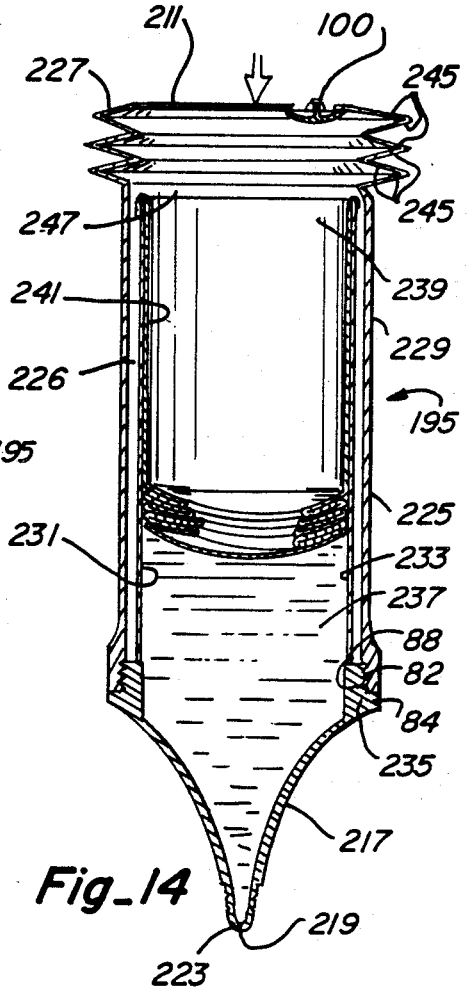
FIG. 14 is a cross sectional view of the device shown in FIG. 13.

FIGS. 13 and 14 illustrate the containing and dispensing device of this invention. Dispensing device 195, as shown in FIG. 13, may be used in association with a dispensing apparatus 197 including a rack structure 199 for holding device 195 for activation thereof to cause dispensing of matter therefrom, as more fully set forth hereinbelow, by movable arm 201.

Dispensing apparatus 197 may be made mountable on bracket portion 203. Arm 201, which may be manually manipulable or be made mechanically responsive to a servomechanism or the like, is mounted on hinges 205 to framework member 207, and includes framework member 209 in contact with bottom portion 211 of device 195. The device is maintained in framework 199 through bracket mount 213 at the mid-portions of the device, and bracket mount 215 through which nozzle 217 is maintained. As will be more fully set forth hereinbelow, by depressing arm 201, contents of device 195 are expelled through outlet opening 219.

The embodiment of the device shown in FIGS. 13 and 14 is similar in many regards to the device shown in FIGS. 6 and 7 including, for example, utilization of one-way flow control valve 100, sealing ridge 84, and internal and external connecting threads 88 and 82, respectively.

As illustrated in FIG. 14, one-way flow control valve 223, for example a flapper valve, is integrally formed in the tip of nozzle 217 at outlet opening 219. Outer container 225 at least in part forms a chamber 226 at the interior thereof and includes a compressible pressure reducing structure 227, for example a bellows type structure, connected between bottom portion 211 and side wall 229 of outer container 225.

Material handling portion 231 of device 195, including nozzle 217, has a tubular portion 233 connected at base structure 235 of nozzle 217, within which a substantial amount of the contents of handling portion 231 are maintained.

Tubular portion 233 has open ends 237 and 239, with open end 239 having readily reshapable bladder 241 affixed to portion 233 adjacent thereto. Portion 233 is a relatively rigid structure relative to bladder 241 and bladder 241 has a volume and shape when fully inflated which preferably substantially corresponds to the volume and shape of relatively rigid portion 233 and nozzle 217.

Upon application of pressure to bottom portion 211 of outer container 225, volume reducing structure 227 is compressed by the movement of the bellows like wall segments 245 of the structure toward one another thereby effectively reducing volume 247 of outer container 225. Since valve 100 will be maintained in a closed position during pressurization of outer container 225, readily reshapable bladder 241 is partially inflated thus being forced a distance into relatively rigid member 233 and displacing an equal volume of the contents within member 233 and expelling contents through valve 223 and outlet opening 219.

When pressure on bottom portion 211 ceases, volume reducing structure 227 resiliently regains its original shape, thus creating a partial vacuum in volume 247 of outer container 225 and opening one-way valve 100 allowing fluid flow therethrough and thus maintaining the partial inflation of bladder 241 so that bladder 241 maintains its new position in relatively rigid tubular portion 243.

As may be appreciated, the portions of the device may be separately formed and assembled as heretofore set forth, or, may be formed as unitary structures, for example by blow molding or the like bladder 241, relatively rigid tubular member 233 and nozzle 217 in a single operation.

Figure 15:
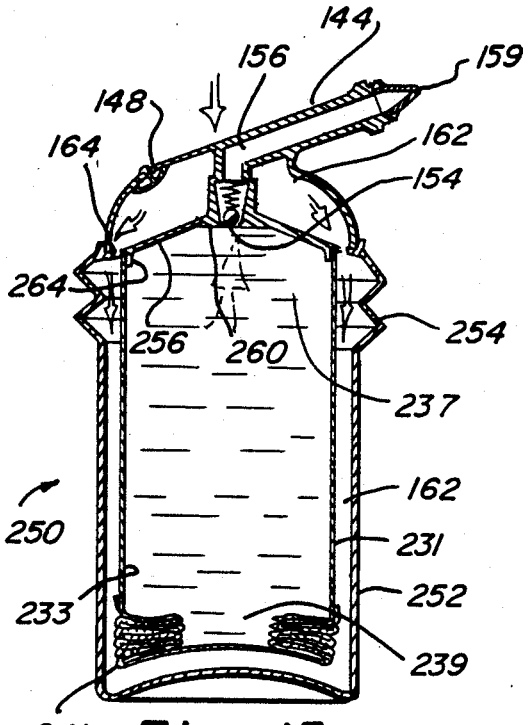
FIG. 15 is a sectional view of an alternate embodiment of the dispensing device of this invention.
Figure 16:
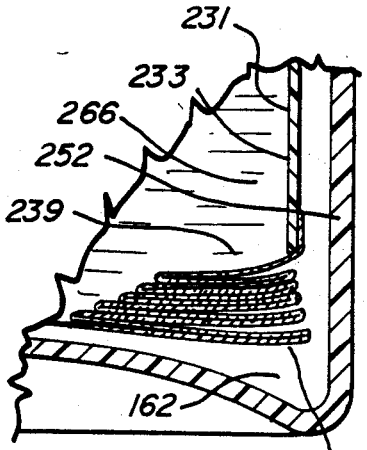
FIG. 16 is an enlarged partial sectional view of the device shown in FIG. 15 particularly illustrating a portion of the structure of the inner containment portion of the device.

Turning now to FIGS. 15 and 16, an alternative embodiment of the containing and dispensing device of this invention is shown which is similar in many regards to the device shown in FIGS. 9 and 10. Dispensing device 250 includes nozzle 144, one-way valve 148, one-way ball valve 154, dispensing channel 156, outlet opening 159, and annular opening 164 allowing communication between upper and lower portions of volume 162, all as also shown with respect to the embodiment of the device shown in FIG. 10.

However, the embodiment of the device shown in FIG. 15 includes an outer container 252 having a volume reducing structure 254 positioned at the upper portions thereof which operates in a fashion similar to that described with regard to volume reducing structure 227 heretofore described with the exception that pressure is applied by a user of the device to the upper portion of the container (as indicated by the arrow in FIG. 15).

In addition, dispensing device 250 includes nozzle base 256 connected to wall 258 of dispensing channel 156 at inlet terminus 260 to channel 156. Relatively rigid tubular portion 233 is attached at open end 237 thereof to nozzle base 256, for example at annular mounting ridge 264 (although it is to be realized that a unitary blow molded structure could also be provided).

As set forth in the description of FIG. 14, readily reshapable bladder 241 is affixed to open end 239 of relatively rigid tubular portion 233 for inflation thereof responsive to reduction of volume 162 by movement of volume reducing structure 254 as heretofore described.

As shown in FIG. 16, when the contents to be expelled from the device fully occupy available volume 266 of handling portion 231, bladder 241 is gathered at open end section 239 of relatively rigid tubular portion 233.

A variety of materials may be used in constructing the dispensing device of this invention. The construction of the device may include one, two, three or more components thereby allowing for selective disposability and/or reuse of all or portions of the dispensing device.

Use of an inner dispensing and containment portion having a relatively rigid tubular structure, nozzle, and readily reshapable, inflatable bladder allows for greater safety and integrity of the contents of the inner portion against leakage and the like during shipment and/or use of the device, and is particularly useful where the outer container is reusable and the inner dispensing and containment portion is disposable and would thus be typically supplied separately from the outer containment portion.

Additionally, a more complete evacuation of the contents of the inner containment portions may be achieved through use of the curved nozzle base. Nozzle extenders of many and varied uses may be constructed for attachment to the dispensing device and the nozzle may be constructed to receive caps for sealing the dispensing channel, thus further preventing contaminants from reaching either the dispensing channel or material to be dispensed from the dispensing device.

In summary, an improved dispensing device for containing and dispensing predetermined, usually noncompressible, materials is shown herein including an inner container having a readily reshapable portion and a nozzle housed in an outer container, and which makes use of one-way valving positioned to permit ejection of the contents of the inner container through the nozzle but precludes passage of contaminants into the inner container. The nozzle may be configured to effect a more complete evacuation of materials from the inner container. A second one-way valve is positioned to admit air from the exterior of the device to a volume defined between the inner container and the outer container, while precluding passage of air from the volume to the exterior of the device, for maintaining a sufficient volume of air between the inner and outer containers to allow continued evacuation of the contents of the inner container when pressure is applied to the outer container, or the volume of the outer container is otherwise selectively reduced, without regard to the position of the device or volume of content remaining in the device.

What is claimed is:

1. A device for containing and dispensing a predetermined material comprising:

material handling means for containing and enabling dispensing of said predetermined material, at least a first part of said material handling means being readily reshapable, said material handling means having an outlet opening therein with first flow control means positioned thereat oriented to allow dispensing of said predetermined material therethrough but substantially precluding passage of matter into said material handling means through said outlet opening; and outer containment means for receiving and containing at least said first part of said material handling means and including an end portion, a body portion and a compressible volume reducing structure positioned between said end portion and said body portion for enabling selective volume reduction of said outer containment means when said volume reducing structure is compressed between said end portion and said body portion by force directed against at least one of said end portion and said body portion, said body portion and said volume reducing structure being directly connected to one another to permit unregulated flow of matter therebetween, said outer containment means having second flow control means positioned to permit flow of matter from the exterior of said outer containment means to an area between said outer containment means and at least said first part of said material handling means but substantially precluding passage of matter from said portion of said volume to the exterior of said outer containment means.

2. The device of claim 1 wherein said material handling means includes a second part which is relatively rigid relative to said first part, wherein said first part of said material handling means is connected to said second part, and wherein said outlet opening is in said second part of said material handling means.

3. The device of claim 2 wherein said second part of said material handling means includes a nozzle portion having said outlet opening therein.

4. The device of claim 1 wherein said volume reducing structure is a bellows structure, said device further comprising mounting means for receiving and maintaining said outer containment means therein and including user activated dispensing means for selectively directing force against said end portion of said outer containment means to thus compress said volume reducing structure.

5. The device of claim 1 wherein said material handling means includes a nozzle, and wherein said nozzle and said body portion have opposed engagable surfaces comprising an outwardly facing engaging surface on said nozzle and an inwardly facing engaging surface on said body portion of said outer containment means.

6. The device of claim 1 wherein said material handling means includes a nozzle having an annular ridge, wherein said outer containment means includes a retainer ring section engagable with said body section, and wherein said annular ridge of said nozzle engages said body section and is maintained thereat by engagement of said retainer ring section with said body section.

7. A device for containing and dispensing a predetermined material comprising:

material handling means for containing and enabling dispensing of said predetermined material, said material handling means including first and second portions connected to each other at open end sections thereof, said open end sections each having a substantially similar configuration, with said first portion being relatively rigid with respect to said second portion and with said second portion being readily reshapable and receivable into said first portion, said first portion having an outlet opening therein with first flow control means positioned adjacent thereto oriented to allow dispensing of said predetermined material therethrough but substantially precluding passage of matter into said material handling means through said outlet opening; and containment means, at least a part of which is compressible, forming at least in part a chamber which receives said first and second portions of said material handling means, with said first portion extending a substantial distance into said chamber, said containment means having second flow control means positioned to permit flow of matter from the exterior of said containment means to the volume defined between said containment means and said material handling means but substantially precluding passage of matter from said volume to the exterior of said containment means, whereby said second portion is caused to be received into said first portion during dispensing of said material from said device upon compression of said containment means.

8. The device of claim 7 wherein said first portion and said second portion of said material handling means each have a predetermined volume, and wherein said volumes thereof are initially substantially the same.

9. The device of claim 7 wherein said containment means includes a compressible body portion.

10. The device of claim 7 wherein said first portion includes a nozzle portion having said outlet opening therein.

11. The device of claim 7 wherein said containment means includes a body section and a retainer ring section engagable with said body section, wherein said first portion of said material handling means includes an annular ridge for engaging said body section, and wherein said body section and said retainer ring section have opposed engagable surfaces whereupon engagement of said opposed engagable surfaces said annular ridge is clamped between said body section and retainer ring section.

12. The device of claim 7 wherein said material handling means includes a nozzle connected with said first portion, and wherein said nozzle, said first portion and said second portion form a unitary structure.

13. The device of claim 7 wherein said containment means includes a body portion, and wherein said first portion of said material handling means and said body portion have opposed engagable surfaces comprising an outwardly facing engaging surface on said first portion and an inwardly facing engaging surface on said body portion of said containment means.

14. The device of claim 13 wherein said first portion includes a nozzle having said outlet opening therein, and wherein said outwardly facing engagable surface is positioned on said nozzle.

15. The device of claim 7 wherein said containment means has a body portion having an upper section, a lower section and a compressible volume reducing structure connected between said upper and lower sections, and wherein said upper section of said body portion has said second flow control means therein and includes a dispensing channel communicating with said outlet opening of said first portion of said material handling means.

16. A device for containing and dispensing a flowable substance comprising:

material handling means for containing and enabling dispensing of said substance and including a relatively rigid portion having first and second open end sections, a nozzle portion connected with said first open end section of said relatively rigid portion and an readily reshapable portion having an open end section connected to said second open end section of said relatively rigid portion, said nozzle portion having an outlet opening therein with first one-way valving means positioned thereat oriented to allow dispensing of said flowable substance therethrough but substantially precluding passage of matter into said material handling means through said outlet opening; and outer containment means for receiving and containing said relatively rigid portion and said readily reshapable portion of said material handling means, and including an end portion, a body portion, and a compressible volume reducing structure positioned between said end portion and said body portion for enabling selective volume reduction of said outer containment means when said volume reducing structure is compressed, said body portion and said volume reducing structure being directly connected to one another to permit unregulated flow of matter therebetween, said outer containment means including second one-way valving means positioned to permit flow of matter from the exterior of said outer containment means to the volume defined between said outer containment means and said relatively rigid portion and said readily reshapable portion of said material handling means but substantially precluding passage of matter from said volume to the exterior of said outer containment means.

17. The device of claim 16 wherein said volume reducing structure is a bellows structure compressible between said body portion and said end portion by force directed against at least one of said body portion and said end portion.

18. The device of claim 17 wherein said body portion of said outer containment means and said nozzle portion of said material handling means have opposed engagable surfaces comprising an outwardly facing engaging surface on said nozzle portion and an inwardly facing engaging surface on said body portion of said outer containment means.

19. The device of claim 16 wherein said relatively rigid portion and said nozzle portion of said material handling means have said flowable substance therein, wherein said relatively rigid portion and said nozzle portion of said material handling means define a volume, and wherein said readily reshapable portion has a volume when fully extended into said relatively rigid portion and said nozzle portion substantially the same as said volume of said relatively rigid portion and nozzle portion of said material handling means.

* * * * *